US006915603B2

(12) United States Patent
Hunt

(10) Patent No.: US 6,915,603 B2
(45) Date of Patent: Jul. 12, 2005

(54) EDGE PROTECTOR

(75) Inventor: Raymond Hunt, Much Wenlock (GB)

(73) Assignee: ITW Limited, Swansea (GB)

( * ) Notice: Subject to any disclaimer, the term of this patent is extended or adjusted under 35 U.S.C. 154(b) by 103 days.

(21) Appl. No.: 10/092,726

(22) Filed: Mar. 8, 2002

(65) Prior Publication Data

US 2002/0133987 A1 Sep. 26, 2002

(30) Foreign Application Priority Data

Mar. 22, 2001 (GB) ..... 0107211

(51) Int. Cl.[7] ..... B65D 81/02; B65D 19/00

(52) U.S. Cl. ..... 40/312; 206/386; 206/586; 206/453; 108/55.1

(58) Field of Search ..... 206/586, 594, 206/453, 386; 40/310, 312; 108/55.1

(56) References Cited

U.S. PATENT DOCUMENTS

| | | | | |
|---|---|---|---|---|
| 2,991,856 A | | 7/1961 | Bewen | |
| 3,049,260 A | | 8/1962 | Stone | |
| 3,989,397 A | | 11/1976 | Baker | |
| 4,012,878 A | * | 3/1977 | Ellingson | 52/288.1 |
| 4,078,716 A | | 3/1978 | Harley et al. | |
| 4,292,901 A | * | 10/1981 | Cox | 108/55.1 |
| 4,742,916 A | | 5/1988 | Galea | |
| 4,877,673 A | | 10/1989 | Eckel et al. | |
| 5,115,917 A | * | 5/1992 | Schrage | 206/586 |
| 5,251,753 A | * | 10/1993 | Pigott et al. | 206/766 |
| 5,517,794 A | * | 5/1996 | Wagner | 52/276 |
| 5,538,178 A | * | 7/1996 | Zink et al. | 229/117.01 |
| 6,286,683 B1 | * | 9/2001 | Hunt et al. | 206/586 |
| 6,564,993 B1 | | 5/2003 | Wassink | |

FOREIGN PATENT DOCUMENTS

| | | |
|---|---|---|
| FR | 877451 | 12/1942 |
| FR | 2747374 | 10/1997 |
| GB | 331630 | 7/1930 |
| GB | 1247987 | 9/1971 |
| GB | 1451893 | 10/1976 |
| GB | 2112752 | 7/1983 |
| GB | 2348688 | 10/2000 |
| JP | 9226823 | 9/1997 |
| WO | 9521774 | 8/1995 |

* cited by examiner

*Primary Examiner*—Cassandra Davis
(74) *Attorney, Agent, or Firm*—Lowe Hauptman & Berner, LLP

(57) ABSTRACT

An edge protector (1) for protecting the edge of an article includes a pair of interconnected, non-parallel, first arms (2, 4) which, in use, do not contact any part of the article, and a pair of second arms (10, 12) for contacting or a least being situated adjacent the article in use, one of each of the second arms (10, 12) being connected to one of each of the first arms (2, 4) each first arm (2, 4) and the respective second arm (10, 12) may be arranged in non-parallel relations. Further, the edge protector (1) may be resiliently deformable to absorb the energy of an impact therewith.

26 Claims, 2 Drawing Sheets

EDGE PROTECTOR

TECHNICAL FIELD

This invention relates to an edge protector, a transit package, a display means and a method of protecting the edge of an article.

BACKGROUND ART

It is well established in the conveying arts that it is often necessary to protect the edges of palletised goods whilst in transit. Damage can be caused to palletised goods in a variety of ways and such damage has the effect of reducing profits for the retailer, transporter and/or manufacturer. Consequently, so-called edge protectors are often used to protect the edges of palletised goods to avoid, or at least reduce, such damage. Examples of known edge protectors are disclosed in U.S. Pat. Nos. 4,877,673, 4,742,916 and 3,049,260.

It is further known that certain positions within a shop, such as a supermarket, are more likely to lead to a purchase by a consumer. For example, promotional items or goods on special offer are often displayed at the ends of aisles. Such displays tend to elicit a greater deal of attention from both casual observers and active shoppers, thereby hopefully leading to a purchase.

Aisle-end displays often require goods to be located within dedicated display means, such as large containers, often large cardboard boxes. These large containers are normally decorated with advertising literature regarding the product or other promotional information.

In use, a retailer will either accept a delivery of the goods to be promoted and an associated display means which will be assembled and located with the goods therein at the requisite site in the store or, alternatively, the manufacturer will send the goods to the retailer, already packaged in the display means and ready to be displayed.

These known display means are expensive and, if transported whilst laden, that is already containing the product, they are liable to be damaged on route. Such damage will obviously be expensive for the parties involved, as well as ruining the appearance of the display means within the store and/or the so-packaged goods.

SUMMARY OF THE INVENTION

It is an object of the present invention to provide an improved, robust edge protector which may be used to provide display means for goods and which can be manufactured cheaply and thereby provide savings of both material and capital to manufacturers and retailers.

According to the first aspect of the invention there is provided an edge protector for protecting the edge of an article, the edge protector comprising a pair of interconnected, non-parallel, first arms which, in use, do not contact any part of the article, and a pair of second arms for contacting or at least being situated adjacent the article in use, one of each of said second arms being connected to one of each of said first arms and characterised in that a portion of each of said second arms is arranged in non-parallel relations to its' respective first arm.

A second aspect of the invention provides an edge protector for protecting the edge of an article the edge protector comprising a pair of interconnected, non-parallel, first arms which, in use, do not contact any part of the article, and a pair of second arms for contacting or at least being situated adjacent the article in use, one of each of said second arms being connected to one of each of said first arms, and being characterised in that the edge protector is resiliently deformable so as to absorb energy from an impact therewith.

There is further provided, in a third aspect of the invention, a transit package comprising a base portion, such as a pallet, having located thereon an article to be transported and a plurality of edge protectors as previously defined, each edge protector being located at an edge of the article and preferably being retained in place at that edge by retaining means such as shrink-wrap, rope, string, straps and so on.

There is also provided, in a further aspect of the invention, a display means comprising a set of edge-defining members and a set of wall members, each wall member having a peripheral portion thereof located and retained within a recess of an edge-defining member, the recess being defined by a pair of generally parallel arms, only one of which being located, in use, adjacent the goods to be displayed, the other being distant, in use, from said goods and defining an air gap adjacent the vertex of the goods and being characterised in that each recess tapers so as to provide a clamping action on each peripheral portion of the wall members located therein.

Preferably, the goods located within the display means are piled as a regular stack of goods.

Preferably there is an equal number in the set of wall members and set of edge-defining members.

A fifth aspect of the invention provides a method of protecting the edge of an article comprising locating and retaining, for example during transport or storage or display, at that edge an edge protector as previously defined.

The article may comprise a stack or pile of goods.

The edge protectors or edge-defining members are preferably made from a durable material. They may be constructed from a plastics material such as polyvinyl chloride or polyethylene. The plastics material may be coloured or have another decorative finish. Alternatively, the edge protectors may be made from materials derived from wood; hardboard, plasticised cardboard and so on, or composite materials such as material derived from a mixture of wood or paper pulp and a rubber material.

In an embodiment of the invention, the edge protector or edge-defining member may comprise a recess into which reinforcement means may be insertable.

BRIEF DESCRIPTION OF THE DRAWINGS

In order that the invention may be better understood it will now be described by way of example and with reference to the accompanying drawings, in which.

DETAILED DESCRIPTION OF THE INVENTION

Figure 1:
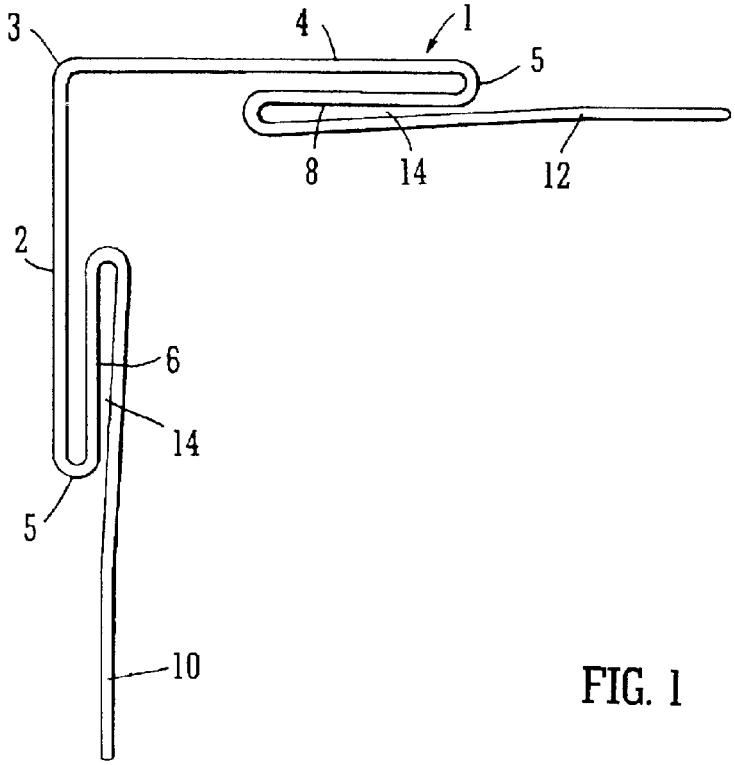
FIG. 1 shows a plan view of an edge-protector.

Referring firstly to FIG. 1, there is shown a plan view of an edge protector 1 which comprises a plurality of interconnected wall members 2, 4, 6, 8, 10, 12.

The edge protector 1 comprises a pair of first, perpendicular arms 2, 4 connected to one another at a vertex 3 extending the entire length of the protector 1, normal to the plane of the paper, as viewed. At the distal edges 5 of each perpendicular arm 2, 4 there is connected an arm portion 6, 8, each of which is located parallel to the respective perpendicular arms 2, 4. Each arm portion 6, 8 is connected to a second arm 10, 12, the gap or recess 14 therebetween being tapered such that it narrows from the point of connection of each arm portion 6, 8 to its respective second arm 10, 12.

The whole of each half of the edge protector 1 (first arm 2, arm portion 6, second arm 10) has a generally S-shaped profile, in cross-section.

The edge protector 1 can be made from a plastics material such as polyvinyl chloride or polyethylene or from a wood or paper derived substance, hardboard, plasticised cardboard or other materials which would provide a rigid, durable and damage resistant protector 1. A preferred material is rubber particles retained within a paper-pulp derived matrix.

Figure 2:
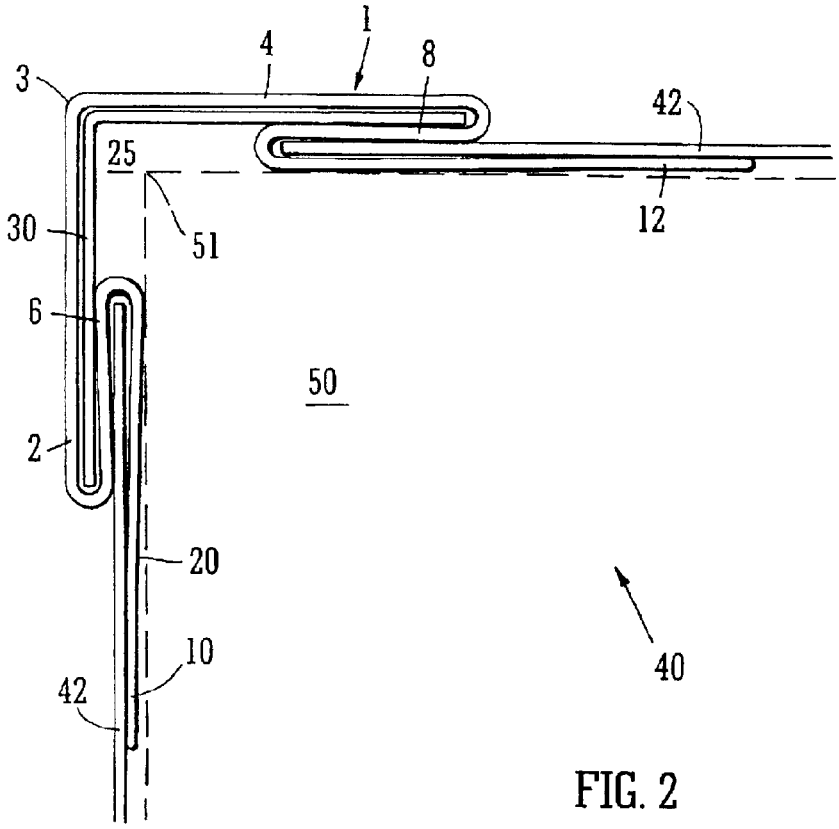
FIG. 2 shows a plan view of the edge protector of FIG. 1 together with wall members.

In use, the edge protector may be simply presented to the edge of an article to be protected, such as a stack of goods, such that the inner surface 20 of each arm 10, 12 abuts or is at least adjacent the article. As seen in FIG. 2, where the edge or corner of the article 50 is represented by a dotted line, the vertex 51 of the article is not adjacent any of the wall portions of the protector 1.

The edge protector 1 may be retained in position by any known means. For example, the article may be shrink-wrapped in plastics sheet once the edge protectors 1 have been located on the article. Similarly, straps, rope, string, adhesives and so on may be used.

As previously mentioned, once the edge protector 1 is installed on an article there is an air gap 25 between the inner surface of the vertex 3 and the vertex 51 of the article. The air gap 25 provides a cushion to the article to protect it any impact in that region. Although it is preferable that the protector 1 should be constructed from a rigid material, the configuration of the wall members 2, 4, 6, 8, 10, 12 provides a degree of resilience. Thus, during an impact incident, the members, for example 2, 6 and 10, may be forced together, absorbing at least some of the energy of the impacting force. The members 2, 6, 10, subsequent to the removal of the force or at least to its' reduction in magnitude, can then return to their original configuration.

If further corner protection is required, one may locate in the air gap 25 a conventional perpendicular edge protector 30, as shown in FIG. 2. Such further protection 30 will not hinder the resilient operation during an impact incident as discussed above, but will afford the corners 50 of an article further protection.

Figure 3:
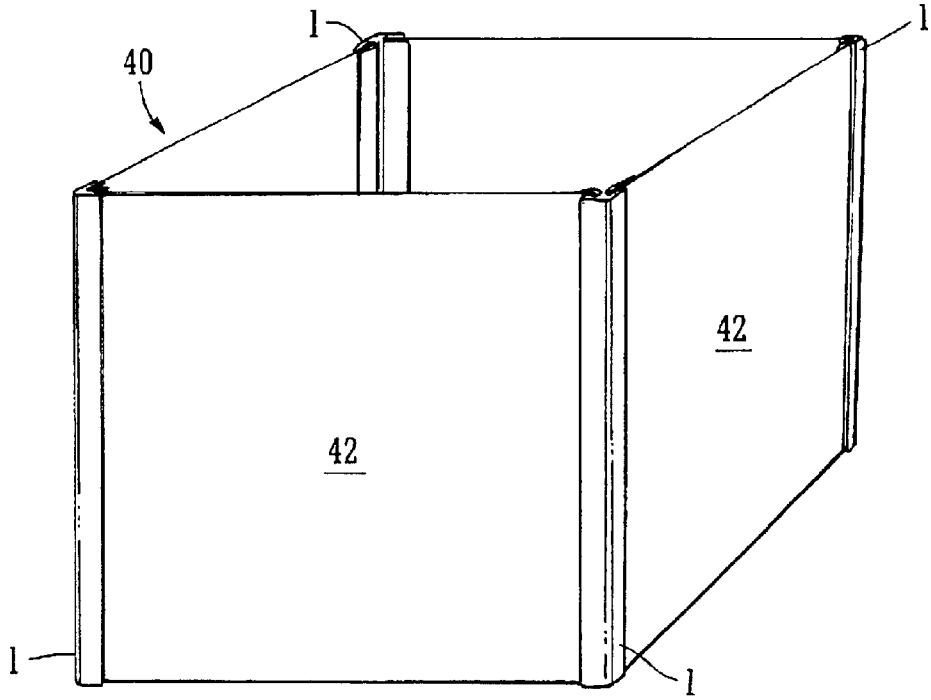
FIG. 3 is a perspective view of the edge protector and wall members of FIG. 2.

As also shown in FIGS. 2 and 3, the edge protector 1 of the invention can be used to provide a display case 40, for the display of goods or other articles. As can be seen, sheet material 42 can be held in the gap or recess 14 defined by each arm portion 6, 8 and the respective arm 10, 12, to which it is connected. The taper of the recess 14 helps to retain the sheet material 42. In a preferred embodiment, the recess 14 tapers from 3.5 mm to 2 mm, the smallest extent being of a size similar to or slightly smaller than the thickness of the sheet material 42. Such a configuration enables the arm portions 6, 8 and their respective arms 10, 12 to provide a clamping effect on any so-sandwiched sheet material 42.

In order to provide a display case 40, an edge-protector 1 is located at each corner of an article or stack of articles and sheet material 42 is located and retained within the recesses 14, each sheet 42 being held in a recess 14 of two edge-protectors 1.

One, some or all of the walls defined by the sheet material 42 may comprise apertures through which the displayed goods or articles may be accessed. The display case 40 may also be provided with a lid member to prevent access to the goods or articles from the top of the case 40.

In the above discussion, the focus has been on the protection of rectangular articles or the display of rectangular display cases. However, it is permissible to provide an edge protector to protect the corner of a non-rectangular article, such as a triangular article, or an article of other polygonal form for example.

Figure 4:
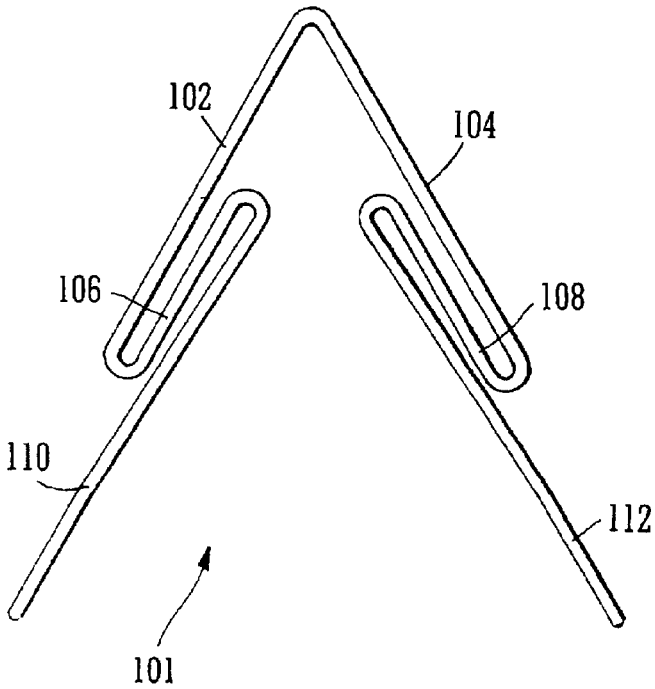
FIG. 4 is a plan view of a second embodiment of edge protector.

With reference to FIG. 4, there is shown an edge protector 101 for the protection of triangular articles. In such an embodiment, the wall members 102, 104, 106, 108 of each respective half of the protector 101 are located parallel to one another, the arms 110, 112 tapering with respect to the wall members 102, 104, 106, 108. Each half of the edge protector 101 (102, 106, 110; 104, 108, 112) is angled with respect to one another to match the angle of the corner of the article. By providing a degree of flexibility to the edge protector 101, by careful consideration of the material of construction, the angle defined by the edge protector 101 need not be exactly that of the article.

It will be readily seen by the skilled addressee, that a triangular display case using the edge protector 101 of FIG. 4, can be readily constructed using the method discussed above.

The walls 42 of the display case may be made from any suitable material, cardboard, hardboard, plastics sheet and so on. The sheet material 42 and/or edge-protectors 1 may have thereon advertising, promotional or other information, pictures and so on. Alternatively, the sheet material 42 may be opaque or transparent, coloured or clear plastics or paper material, facilitating back-lighting from the interior of the display case if so desired.

What is claimed is:

1. An edge protector for protecting an edge of an article, the edge protector comprising:

a pair of interconnected, non-parallel, first arms which, in use, do not contact any part of the article; and a pair of second arms for contacting or at least being situated adjacent the article in use, each of said second arms being connected to one of said first arms by a connecting portion to define a half of the edge protector, said half having a generally S-shaped profile in cross section;

wherein a portion of each of said second arms is arranged in non-parallel relations to the respective first arm; and said edge protector is further provided with indicia.

2. An edge protector according to claim 1 fabricated integrally from a durable material.

3. An edge protector according to claim 2, wherein the durable material is a plastics material.

4. An edge protector according to claim 3, wherein the durable material is polyvinyl chloride or polyethylene.

5. An edge protector according to claim 2, wherein the durable material is derived from wood.

6. An edge protector according to claim 5, wherein the durable material is hardboard or plasticized cardboard.

7. An edge protector according to claim 2, wherein the durable material is derived from a composite material.

8. An edge protector according to claim 7, wherein the composite material is derived from a mixture of wood or paper pulp and a rubber material.

9. An edge protector for protecting an edge of an article, the edge protector comprising:

a pair of interconnected, non-parallel, first arms which, in use, do not contact any part of the article;

a pair of second arms for contacting or at least being situated adjacent the article in use, each of said second arms being connected to one of said first arms, wherein a portion of each of said second arms is arranged in non-parallel relations to the respective first arm; and a recess into which reinforcement means are insertable.

10. An edge protector for protecting an edge of an article, the edge protector comprising:

a pair of interconnected, non-parallel, first arms which, in use, do not contact any part of the article; and a pair of second arms for contacting or at least being situated adjacent the article in use, each of said second arms being connected to one of said first arms by a connecting portion to define a half of the edge protector, said half having a generally S-shaped profile in cross section;

wherein a portion of each of said second arms is arranged in non-parallel relations to the respective first arm; and the edge protector is resiliently deformable so as to absorb energy from an impact therewith.

11. An edge protector according to claim 10 further provided with indicia.

12. An edge protector according to claim 10, further comprising a recess into which reinforcement means are insertable.

13. A transit package, comprising a base portion having located thereon an article to be transported; and a plurality of edge protectors each comprising:

a pair of interconnected, non-parallel, first arms which do not contact any part of the article; and a pair of second arms contacting or at least being situated adjacent the article, each of said second arms being connected to one of said first arms by a connecting portion to define a half of the edge protector, said half having a generally S-shaped profile in cross section, wherein a portion of each of said second arms is arranged in non-parallel relations to the respective first arm;

wherein each of said edge protectors is located at an edge of the article and is retained in place at that edge by retaining means; and said retaining means comprise one or more of shrink-wrap, rope, string or straps.

14. A transit package according to claim 13, wherein said edge protectors further comprise indicia.

15. A transit package according to claim 13, wherein each of said edge protectors further comprises a recess into which reinforcement means are insertable.

16. A transit package according to claim 13, wherein each of said edge protectors is resiliently deformable so as to absorb energy from an impact therewith.

17. A transit package according to claim 13, wherein, in each half of each of the edge protectors, the portion of the second arm that is arranged in non-parallel relations to the respective first arm is a proximal portion connected to the respective connecting portion, said second arm further comprising a distal portion contiguously extending from said proximal portion away from and parallel to the respective first arm; and said distal portion is slanted at an obtuse angle relative to said proximal portion.

18. A transit package according to claim 13, wherein in each half of each of the edge protectors, the portion of the second arm that is arranged in non-parallel relations to the respective first arm is a proximal portion connected to the respective connecting portion, said second arm further comprising a distal portion contiguously extending from said proximal portion away from and parallel to the respective first arm; and at least one of the edge protectors has the first arms which are slanted at an acute angle relative to each other.

19. A method of protecting the edge of an article, the method comprising locating and retaining, during transport, storage or display, at that edge an edge protector, said edge protector comprising:

a pair of interconnected, non-parallel, first arms which, in use, do not contact any part of the article; and a pair of second arms for contacting or at least being situated adjacent the article in use, each of said second arms being connected to one of said first arms by a connecting portion to define a half of the edge protector, said half having a generally S-shaped profile in cross section;

wherein a portion of each of said second arms is arranged in non-parallel relations to the respective first arm.

20. An edge protector for protecting an edge of an article, the edge protector comprising:

a pair of interconnected, non-parallel, first arms which, in use, do not contact any part of the article; and a pair of second arms for contacting or at least being situated adjacent the article in use, each of said second arms being connected to one of said first arms by a connecting portion to define a half of the edge protector, said half having a generally S-shaped profile in cross section;

wherein a portion of each of said second arms is arranged in non-parallel relations to the respective first arm;

in said half of the edge protector, the portion of the second arm that is arranged in non-parallel relations to the respective first arm is a proximal portion connected to the respective connecting portion, said second arm further comprising a distal portion contiguously extending from said proximal portion away from and parallel to the respective first arm; and in said half of the edge protector, the proximal portion of the second arm and the respective connecting portion together define a recess tapered and open toward the distal portion.

21. An edge protector according to claim 20, wherein, in said half of the edge protector, the connecting portion and the first arm are parallel.

22. An edge protector for protecting an edge of an article, the edge protector comprising:

a pair of interconnected, non-parallel, first arms which, in use, do not contact any part of the article; and a pair of second arms for contacting or at least being situated adjacent the article in use, each of said second arms being connected to one of said first arms by a connecting portion to define a half of the edge protector, said half having a generally S-shaped profile in cross section;

wherein a portion of each of said second arms is arranged in non-parallel relations to the respective first arm;

in said half of the edge protector, the portion of the second arm that is arranged in non-parallel relations to the respective first arm is a proximal portion connected to the respective connecting portion, said second arm further comprising a distal portion contiguously extending from said proximal portion away from and parallel to the respective first arm; and said distal portion is slanted at an obtuse angle relative to said proximal portion.

23. An edge protector according to claim 22, wherein said obtuse angle is close to 180 degree.

24. An edge protector for protecting an edge of an article, the edge protector comprising:

a pair of interconnected, non-parallel, first arms which, in use, do not contact any part of the article; and a pair of second arms for contacting or at least being situated adjacent the article in use, each of said second arms being connected to one of said first arms by a connecting portion to define a half of the edge protector, said half having a generally S-shaped profile in cross section;

wherein a portion of each of said second arms is arranged in non-parallel relations to the respective first arm;

in said half of the edge protector, the portion of the second arm that is arranged in non-parallel relations to the respective first arm is a proximal portion connected to the respective connecting portion, said second arm further comprising a distal portion contiguously extending from said proximal portion away from and parallel to the respective first arm; and said first arms are slanted at an acute angle relative to each other.

25. A transit package, comprising a base portion having located thereon an article to be transported; and a plurality of edge protectors each comprising:

a pair of interconnected, non-parallel, first arms which do not contact any part of the article; and a pair of second arms contacting or at least being situated adjacent the article, each of said second arms being connected to one of said first arms, wherein a portion of each of said second arms is arranged in non-parallel relations to the respective first arm;

wherein each of said edge protectors is located at an edge of the article and is retained in place at that edge by retaining means;

the base portion is a pallet the portion of each of said second arms that is arranged in non-parallel relations to the respective first arm is a proximal portion of said second arm which further comprises a distal portion contiguously extending from said proximal portion away from and parallel to the respective first arm; and said proximal portion is connected to the respective first arm by a connecting portion which, together with said proximal portion, defines a recess tapered and open toward the distal portion.

26. A transit package according to claim 25, wherein said distal portion is parallel to the respective connecting portion and first arm, and is slanted at an obtuse angle relative to said proximal portion.

* * * * *